US006289994B1

(12) United States Patent
Willauer

(10) Patent No.: US 6,289,994 B1
(45) Date of Patent: Sep. 18, 2001

(54) BIDIRECTIONAL TEMPERATURE AND PRESSURE EFFECT COMPENSATOR FOR INFLATABLE ELEMENTS

(75) Inventor: Darrin Willauer, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/290,652

(22) Filed: Apr. 12, 1999

(51) Int. Cl.[7] ..... E21B 33/128
(52) U.S. Cl. ..... 166/387; 166/187
(58) Field of Search ..... 166/383, 387, 166/187

(56) References Cited

U.S. PATENT DOCUMENTS

| | | | | |
|---|---|---|---|---|
| 4,655,292 | | 4/1987 | Halbardier | 166/387 |
| 5,058,673 | * | 10/1991 | Muller et al. | 166/187 |
| 5,271,469 | | 12/1993 | Brooks et al. | 166/387 |
| 5,462,121 | * | 10/1995 | Schmuck et al. | 166/383 |
| 5,577,560 | * | 11/1996 | Coronado et al. | 166/387 |
| 5,605,195 | * | 2/1997 | Eslinger et al. | 166/387 |

FOREIGN PATENT DOCUMENTS 2322394 8/1998 (GB) .

* cited by examiner

*Primary Examiner*—William Neuder
(74) *Attorney, Agent, or Firm*—Steve Rosenblatt

(57) ABSTRACT

A compensating system for an inflatable element is disclosed which can be responsive to a temperature increase or decrease and still regulate the inflate pressure of the inflatable element, despite fluctuations in pressures above or below the element. A compensating piston with an atmospheric chamber is used. The compensating piston is coupled to a balancing piston. The balancing piston is ported to receive pressure from above the element on one side, and below the element on the other side. When the apparatus is run in the hole, wellbore pressure causes the compensating piston to be in the collapsed position. Upon inflation, the compensating piston strokes. A positioning mechanism positions the compensating piston in the center to allow it to handle both temperature increases and decreases. Upon complete inflation of the element, the positioning mechanism releases the balancing piston to let it float and porting is opened from above and below the inflated element to the balancing piston. The balancing piston applies an opposite load on the compensating piston to counteract either a change in inject pressure from above or formation pressure from below.

30 Claims, 12 Drawing Sheets

BIDIRECTIONAL TEMPERATURE AND PRESSURE EFFECT COMPENSATOR FOR INFLATABLE ELEMENTS

FIELD OF THE INVENTION

The field of this invention relates to compensation devices for maintenance of inflate pressure on an inflatable element in a downhole packer device.

BACKGROUND OF THE INVENTION

Inflatable packers have been in use in the oilfield for many years. These packers include an inflatable element which expands under the application of fluid pressure into contact with the surrounding casing or tubular to effectively seal it off. Downhole conditions can change with regard to temperature. Downhole pressures can also fluctuate due to changes in the formation pressure or injection pressures applied in the annular space above the inflated element. The pressure and/or temperature fluctuations can be quite large. If the temperature of the element increases, the inflate pressure tends to increase. Conversely, if the temperature of the element decreases, the inflate pressure tends to decrease. If these fluctuations are large enough, an element rupture can occur. Alternatively, the element can release from the casing or tubular because of insufficient internal pressures. Temperature changes are frequently accompanied by applied pressure fluctuations. A cold fluid injected into the well or a zone that is shut off can cause the pressure and temperature effects on the inflated element described above. Experience shows that there are very few instances where a temperature change occurs without an accompanying pressure change in one direction or the other.

Compensation devices have been attempted in the past. One example is PCT application WO 98/36152 assigned to Tech Line Oil Tools A.S. In this design, a single floating piston, having two discrete piston areas with an atmospheric chamber in between, is employed. The purpose of this compensation device is to maintain the inflate pressure at a certain ratio above the well pressure, either above or below the element. This design, however, does not accommodate the discrete responses which occur due to pressure and temperature changes which occur contemporaneously. The compensator described by Tech Line is located below the element and attempts to inflate the element by way of compensation, depending on whether a cool-down or heat-up downhole is anticipated. In other words, the specific phenomenon must be anticipated before the tool is run in the wellbore so that the compensating piston will be in the appropriate position after inflation of the element. If cool-down is anticipated, the compensating piston of this design is completely stroked so that upon cool-down, the compensating piston can move uphole toward the element to maintain the internal pressure. Conversely, the compensating piston is not stroked at all if a heat-up is anticipated. In that manner, when the heat-up occurs, downhole movement of the compensating piston can occur to its opposing travel stop to avoid pressure build-up under the element in response to the surrounding heat-up.

However, where the compensator is below the elements as in the Tech Line design, and cool-down is expected, cold fluid is generally being injected from the surface. In these situations, the inject pressure is applied to the element, followed by subsequent cooling of the element. The inject pressure causes the element pressure to increase, and as the element cools, the inject pressure keeps the inflate pressure elevated and renders the compensator ineffective. This is because the compensator is placed in an initial fully stroked position, and while cool-down would bring it back toward the element, the applied inject pressure overcomes the cool-down effect and keeps the compensating piston bottomed against its travel stop, making the compensation system ineffective. This combination of forces causes the element to deform at the wall where the inject pressure is applied and substantially increases the risk of failure due to the possibility of kinking ribs which can cut the wall of the inflatable element.

Again, in the Tech Line design where the element temperature is expected to increase, an accompanying inflation pressure above the element results in fluid being squeezed out of the element so as to drive the compensating piston down. This occurs because due to the anticipated temperature increase, the compensating piston by design is against its travel stop closest to the element when the element is inflated. In that manner, the Tech Line compensator can compensate for temperature increases as the compensating piston moves away from the inflated element. However, temperature increases, coupled with applied pressures outside the element, add together to bring the compensating piston to its downward travel stop position, once again risking severe deformation and damage to the element.

What is needed is a compensating device that is fully functional for temperature increases or decreases which, at the same time, has the ability to respond to applied increases or decreases in pressure from above or below the element. One of the objects of the present invention is to isolate pressure effects, leaving the compensating device the ability to be fully responsive to increases or decreases in temperature, independent of fluctuations in pressures above or below the inflated element. Those and other advantages of the present invention will be more apparent to those skilled in the art by a review of the description of the preferred embodiment below.

SUMMARY OF THE INVENTION

A compensating system for an inflatable element is disclosed which can be responsive to a temperature increase or decrease and still regulate the inflate pressure of the inflatable element, despite fluctuations in pressures above or below the element. A compensating piston with an atmospheric chamber is used. The compensating piston is coupled to a balancing piston. The balancing piston is ported to receive pressure from above the element on one side, and below the element on the other side. When the apparatus is run in the hole, wellbore pressure causes the compensating piston to be in the collapsed position. Upon inflation, the compensating piston strokes. A positioning mechanism positions the compensating piston in the center to allow it to handle both temperature increases and decreases. Upon complete inflation of the element, the positioning mechanism releases the balancing piston to let it float and porting is opened from above and below the inflated element to the balancing piston. The balancing piston applies an opposite load on the compensating piston to counteract either a change in inject pressure from above or formation pressure from below.

DETAILED DESCRIPTION OF THE PREFERRED EMBODIMENT

Figure 1A:
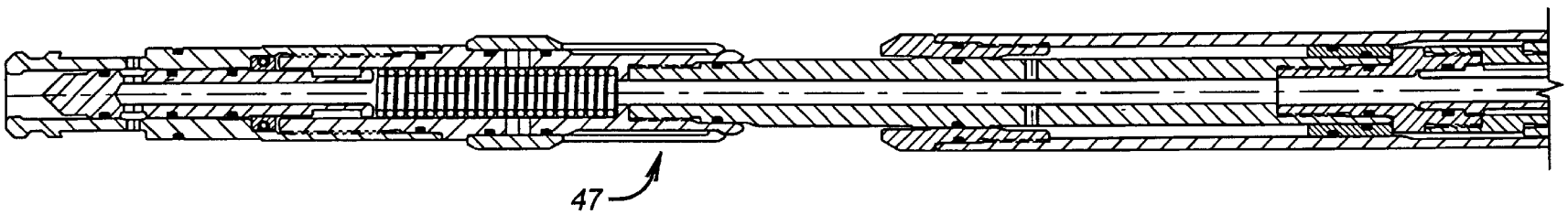
FIGS. 1*a–f* illustrate the compensator in the run-in position.
Figure 2A:
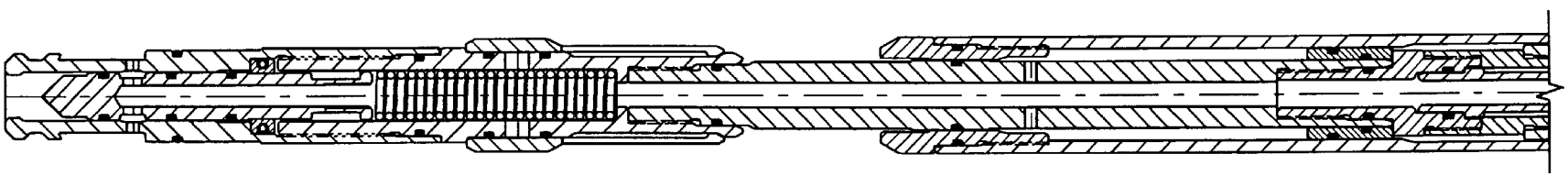
FIGS. 2*a–f* show the compensator in the fully inflated position of the element.
Figure 1B:
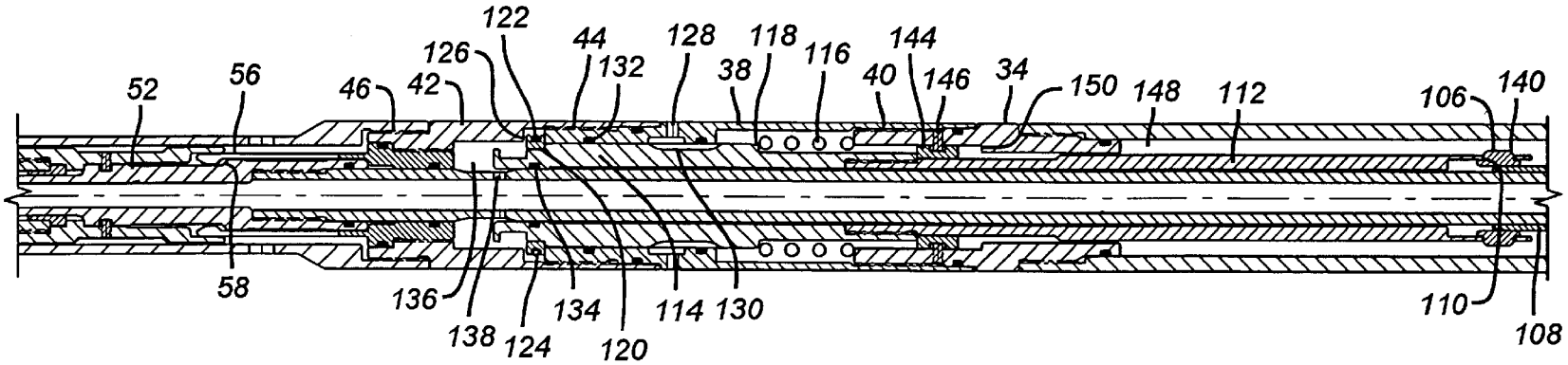
Figure 1C:
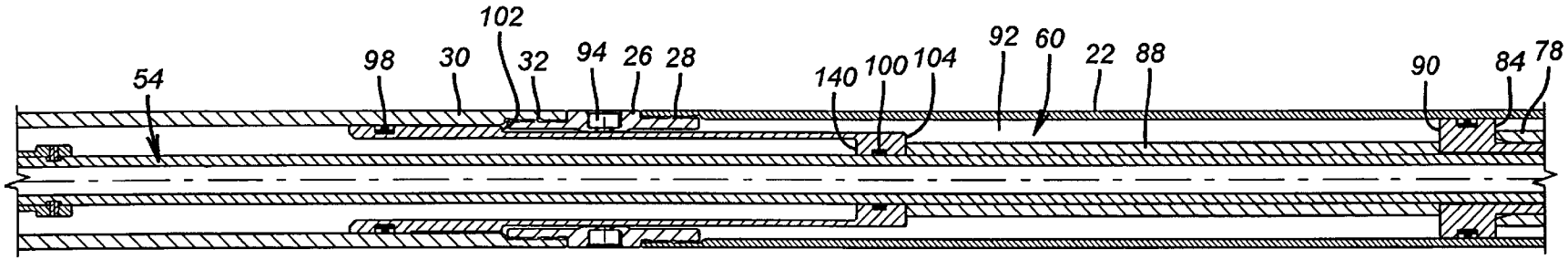
Figure 1D:
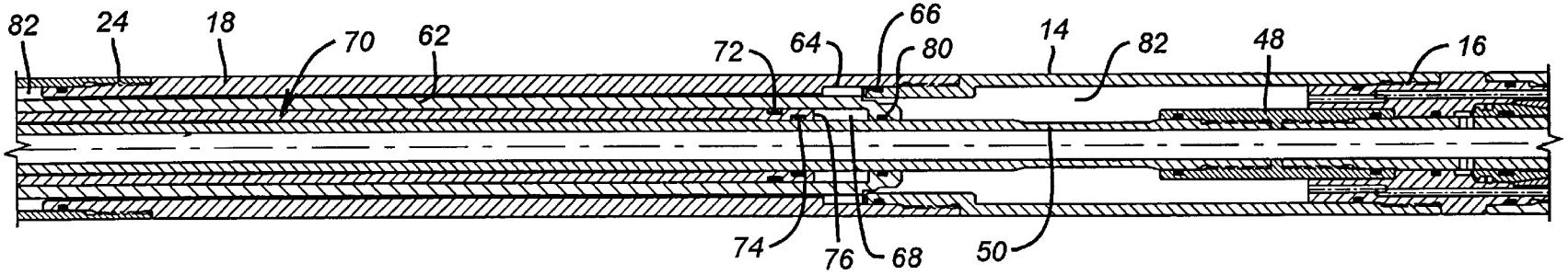
Figure 2D:
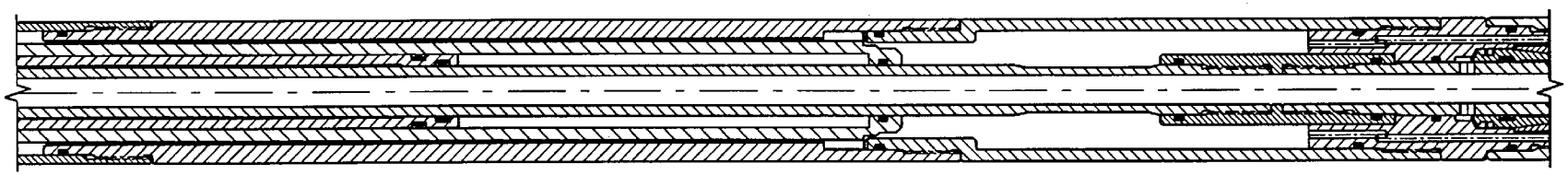
Figure 1E:
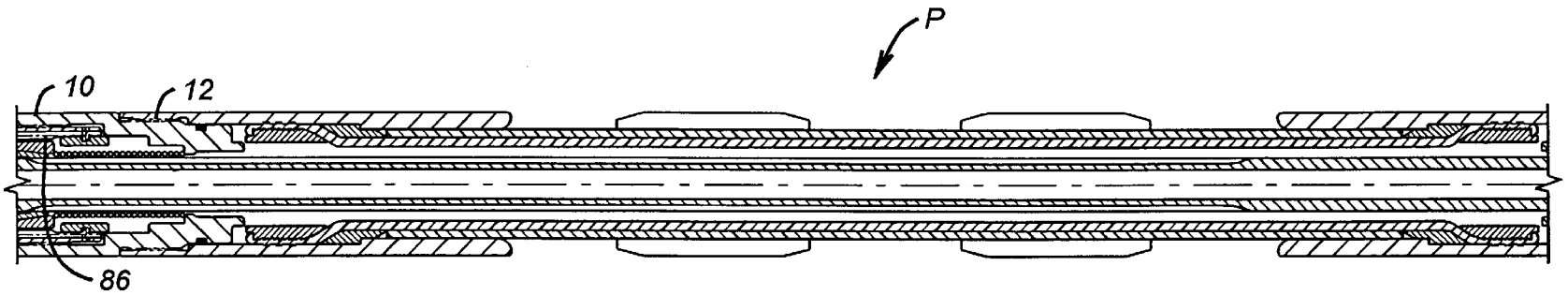
Figure 2E:
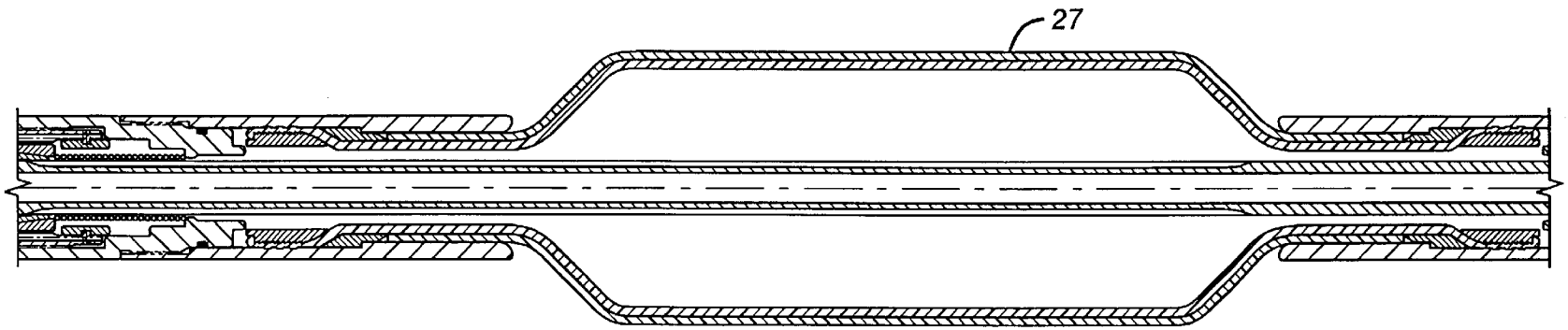
Figure 1F:
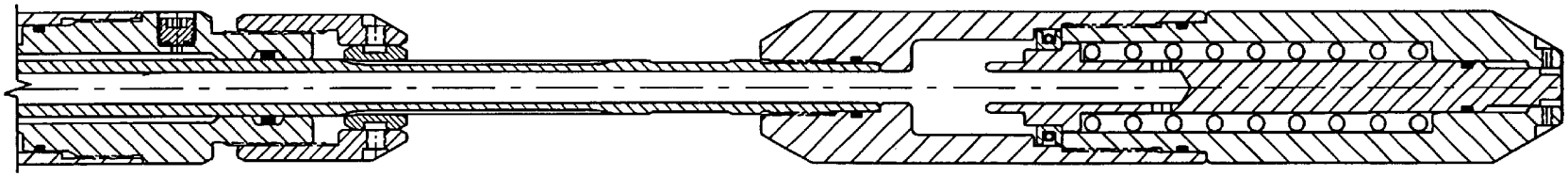
Figure 2F:
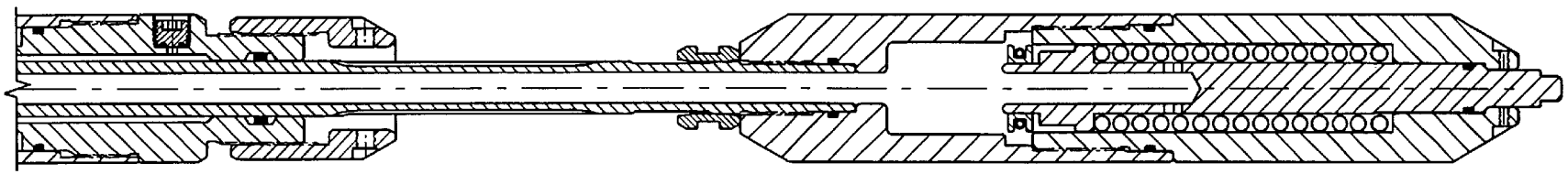
Figure 4A:
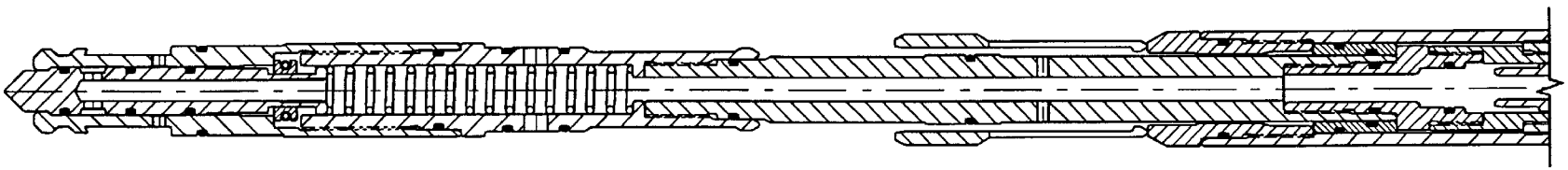
FIG. 4*a–f* show the latch sub being removed from the inflation housing.

Referring to FIGS. 1*a–e*, the compensating device C is installed adjacent to the inflatable packer P. However, shown in FIG. 1*e* is an inflate sub 10, which is connected to an inflatable packer of a known design at thread 12. The inflate sub 10 is connected to inflation housing 14 at thread 16. Lower connector 18 is connected to inflation housing 14 at thread 20. Outer housing 22 is connected to lower connector 18 at thread 24. Filler plug housing 26 is connected to outer housing 22 at thread 28. Upper housing 30 is connected to filler plug housing 26 at thread 32. Shear sub 34 is connected to upper housing 30 at thread 36. Spring housing 38 is connected to shear sub 34 at thread 40. Lock sub 42 is connected to spring housing 38 at thread 44. Thread 46 is used to connect to the bridge plug assembly 47. Accordingly, the entire outer assembly of the compensating device C has been described.

The compensating device C has an interior wall assembly which, beginning in FIG. 1*e*, comprises a multi-component mandrel made up of interconnected sleeves 48 and 50, which is in turn connected to latch sub 52, shown in FIG. 1*b*. These sleeves 48 and 50, as well as latch sub 52, are collectively referred to as the mandrel 54. Mandrel 54 is retained by collet assembly 56, which is in turn secured to lock sub 42. The collet assembly 56 retains a shoulder 58 on the latch sub 52 to hold it in place until the mandrel 54 is ready to be selectively removed. Removal of the mandrel 54 as shown in FIG. 4 will deflate the inflatable element.

Accordingly, what has been defined with the outer assembly and the mandrel is an annular space, generally described as 60, which is broken into discrete areas based on the components located therein. Starting at the lower end or FIG. 1*d*, an outer piston 62 is held in a stationary position due to tab 64 extending into groove 66, which is defined between lower connector 18 and inflation housing 14. Accordingly, the outer piston 62 is trapped against longitudinal movement. The outer piston 62 is a sleeve which defines an annular space 68 between itself and sleeve 50. A compensating piston 70 is disposed in annular space 68 and further contains seals 72 and 74, thus defining a discrete chamber using annular space 68. Those skilled in the art will appreciate that movement of the compensating piston 70 will vary the volume of the annular space which is now a sealed chamber due to the presence of seals 72, 74 and 80. Initially, atmospheric pressure is located in the space 68, and it acts on surface 76 to put a very small uphole force on the compensating piston 70, which varies as a function of its internal pressure. Outer piston 62 has a top end 78 (see FIG. 1*d*), which acts as a lower travel limit for the compensating piston 70. Outer piston 62 further has a seal 80 in contact with sleeve 50 for complete isolation of the space 68, which has an initial charge preferably of atmospheric pressure, but other pressures can be used without departing from the spirit of the invention.

Referring to FIGS. 1*c–e*, it can be seen that compensating piston 70 creates an annular space 82, which extends from surface 84 down to the inflate sub 10. Fluid communication with the inflatable element occurs through passage 86 into space 82, all the way through to surface 84 on compensating piston 70. Space 68 is, of course, isolated from the inflate pressure found in space 82 due to the presence of seals 72, 74, and 80. Accordingly, an increase in the inflate pressure of the element 27 is communicated through passage 86 into space 82 as a force against surface 84.

Inner spacer 88 is mounted above surface 90 on compensating piston 70. The area of surface 90 is designed to be larger than the area of surface 84, with the preferred ratio being approximately 1.3:1. This results in a magnification of the net force applied to the underside of the inflated element due to pressure on surface 90 by a ratio of the areas of surface 90 divided by surface 84. This neglects the area of surface 76 because the pressure acting on it is so low. In the run-in position shown in FIG. 1*c*, the inner spacer 88 merely rests on surface 90.

Compensating piston 70 defines an annular space 92 in which the inner spacer 88 is found. Filler plug housing 26 has a filler port 94, which allows pressure in the annular space in the wellbore outside of filler plug housing 26 and above the inflated element 27 to be communicated into passage 92.

Also located in space 92 is balancing piston 96. Seals 98 and 100 mounted on opposite sides of balancing piston 96 effectively define the variable upper reaches of space 92. Surfaces 102 and 104 are exposed to the pressure in space 92 and through port 94 to the pressure in the annulus in the wellbore above the set inflated element 27.

In the run-in position, dog or dogs 106, supported on a shear ring 108 and extending through an opening 110 in extension sub 112, act as the upper travel limit for the balancing piston 96.

Connected to extension sub 112 is spring piston 114. A spring 116 bears on shear sub 34 on one end and on shoulder 118 on spring piston 114. Resisting the uphole bias of spring 116 is a series of locking segments 120. Locking segments 120 are preferably in quarter sections featuring an external groove 122 within which is located a band spring 124. In the run-in position shown in FIG. 1*a*, the locking segments 120 engage shoulder 126 on lock sub 42. Accordingly, upward movement of the spring piston 114, responsive to the bias force of spring 116, is resisted by contact with shoulder 126 by locking segments 120.

Spring housing 38 has a port 128. Spring piston 114 has a recess 130 opposite port 128 in the run-in position shown in FIG. 1*a*. Seal 132, in conjunction with seal 134, defines an annular space 136 above spring piston 114. During run-in, mandrel 54 is obstructed at its lower end to allow element inflation. As a result of inflation and subsequent release of the bridg plug, mandrel 54 allows communication from below the element to port 138, while above port 138 the mandrel 54 is obstructed. A port 138 extends through the mandrel 54 at sleeve 50 to allow fluid communication from the formation below the inflated element up to and above spring piston 114 at annular space 136. In the run-in position, downward movement of spring piston 114 is limited by shoulder 150. Annulus pressure outside of port 128, in the run-in position, cannot communicate with space 136 due to the presence of seals 132 and 134. However, the presence of recess 130 allows annular pressure through port 128 to communicate down to balancing piston 96 at surfaces 140 and 142. Since the same annulus pressure at port 128 is also present at port 94, and the surface areas of surfaces 102 and 104 are equal to surface areas of surfaces 140 and 142, the balancing piston 96 is in pressure balance during the run-in procedure.

As shown in FIG. 1*b*, a shear release ring 144 is held by a shear pin 146. The shear release ring 144 abuts the spring piston 114 to prevent its downhole movement until a predetermined force exists in annular space 136, as will be explained below.

In the run-in position, another annular space 148 is defined above the balancing piston 96 and extends from surfaces 140 and 142 and on both inside and outside of extension sub 112 and spring piston 114 up to seals 132 and 134 on spring piston 114. In the run-in position, port 128 aligns annulus pressure around the compensating device C into annular space 148. Seals 132 and 134 effectively isolate space 136 from space 148.

The key components of the compensating device having been described, its operation after run-in will now be reviewed in more detail.

Figure 2B:
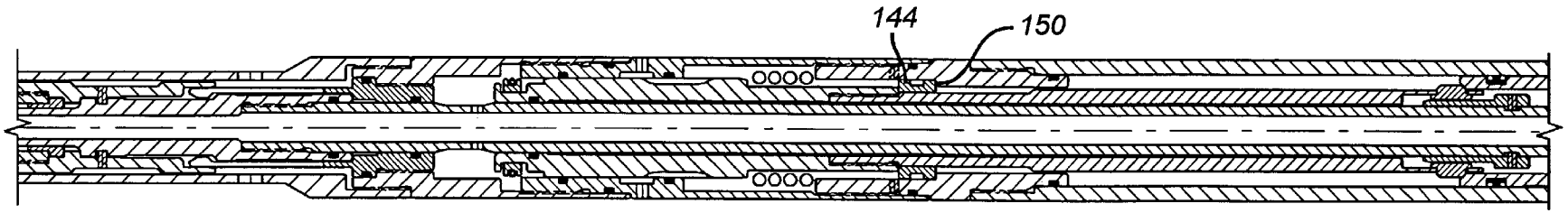
Figure 2C:
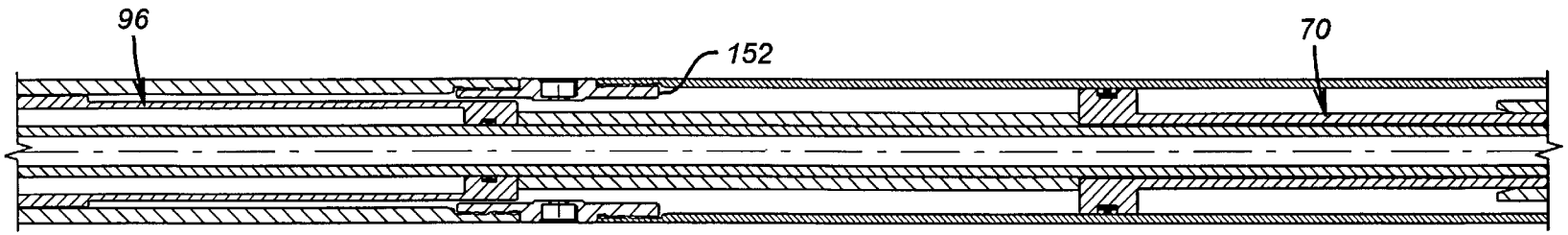

Inflate pressure is applied through the mandrel 54 to the inflatable element. As the pressure inside of the mandrel 54 rises, the pressure in space 136 rises as well due to the open communication because of port 138. Due to ports 128 and 94, communication of external annulus pressure occurs in the area around recess 130 and against surfaces 102 and 104 on balancing piston 96, respectively. Since the annulus pressure remains constant and the internal pressure in the mandrel 54 is building up, a sufficient force imbalance occurs on the assembly of spring piston 114 and extension sub 112. Eventually, the shear pin 146 is broken, allowing the assembly of spring piston 114 and extension sub 112 to move downwardly, compressing spring 116. Downward motion continues until the shear release ring 144 bottoms on shoulder 150. As that movement occurs, the dogs 106 may push the balancing piston 96 downwardly if it happens to be adjacent at that time. At the same time, a rise in the inflate pressure brings the pressure up in passage 86, communicating to annular space 82, thus increasing the pressure seen by surface 84. In view of port 94, the pressure seen at surface 90, which is opposite surface 84 on compensating piston 70, remains the annulus pressure outside the compensating device C. Accordingly, with a build-up of pressure in annular space 82 against a reference pressure of annulus pressure in space 92, the compensating piston 70 moves uphole, taking with it inner spacer 88. The pressure required to initiate this movement in the preferred embodiment where the ratio of surfaces 90 to 84 is 1:1.3 is 30% above annulus pressure. This assumes that the initial pressure in chamber 68 is atmospheric or a negligibly small pressure. Eventually, inner spacer 88 contacts surface 104 on balancing piston 96, as shown in FIGS. 2*b* and 2*c*. FIGS. 2*b* and 2*c* also show the balancing piston 96 somewhat downwardly shifted, with the bottoming of shear release ring 144 on shoulder 150.

As shown in FIG. 2c, the compensating or movable piston 70 is disposed approximately midway between top end 78 of outer piston 62, which comprises the lower travel stop, and shoulder 152, which comprises the upper travel stop. Shoulder 152 is on filler plug housing 26. The spacer 88 dictates the position of compensating piston 70 when it contacts balancing piston 96.

Figure 3A:
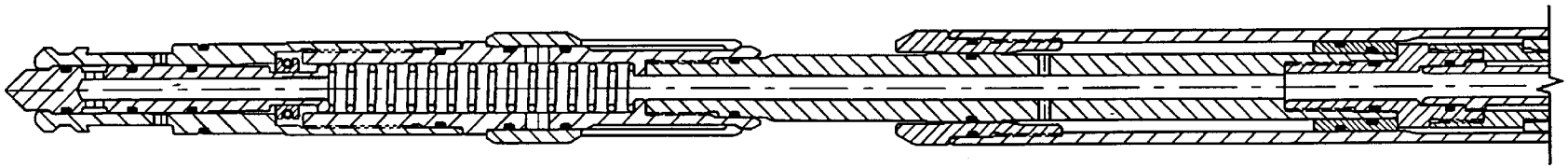
FIGS. 3*a–f* show the porting changed on the balancing piston which is now free to move.
Figure 3B:
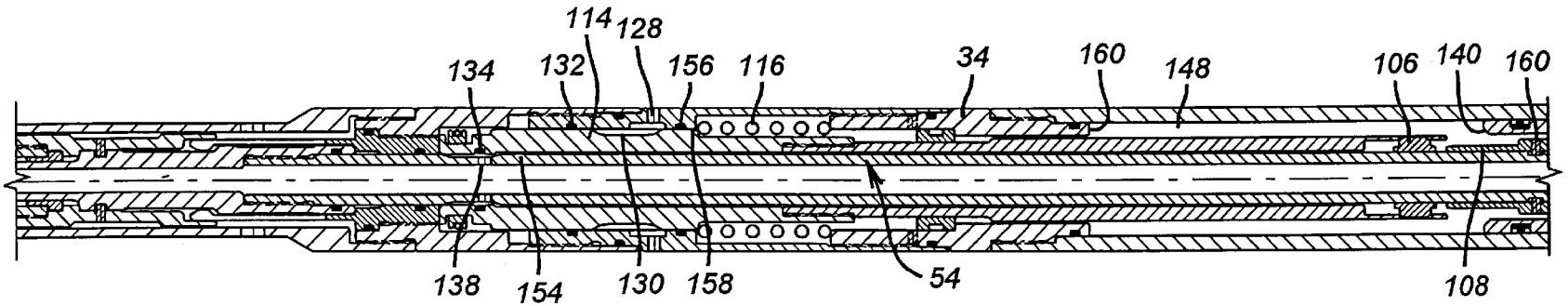
Figure 4B:
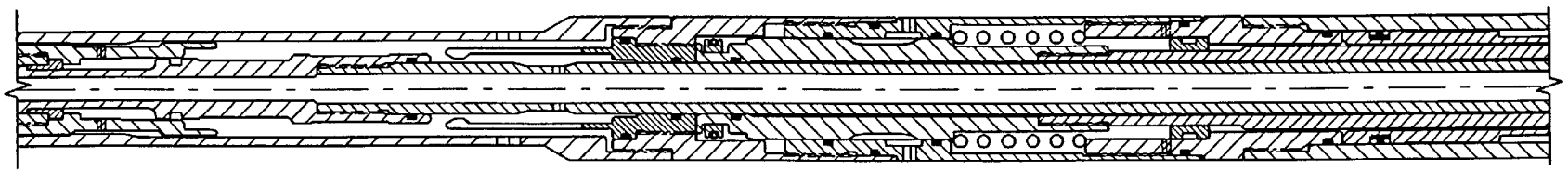
Figure 3C:
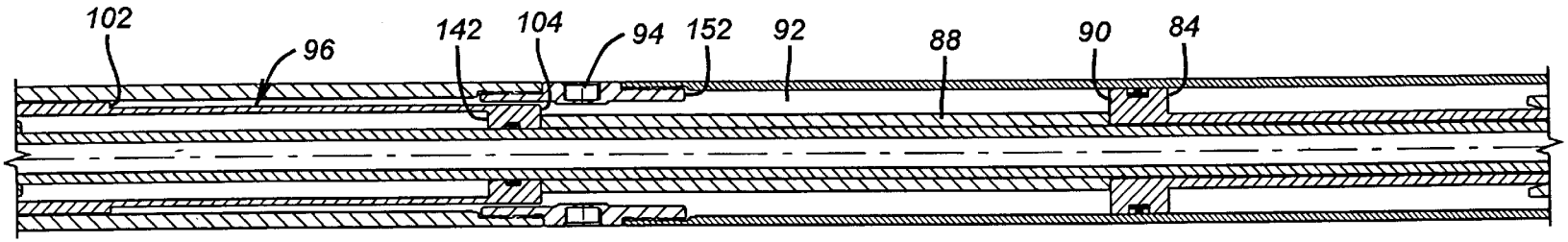
Figure 4C:
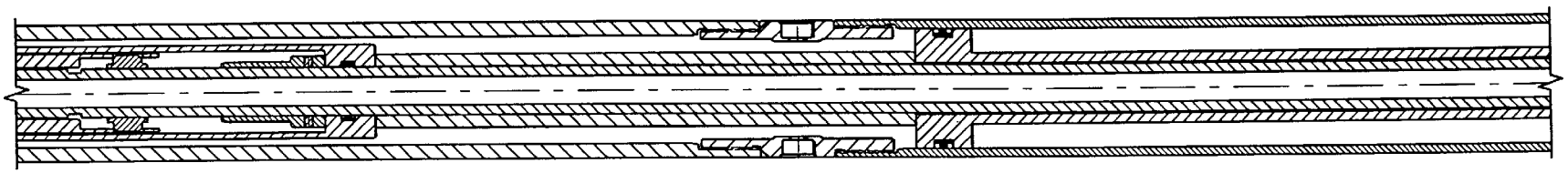
Figure 3D:
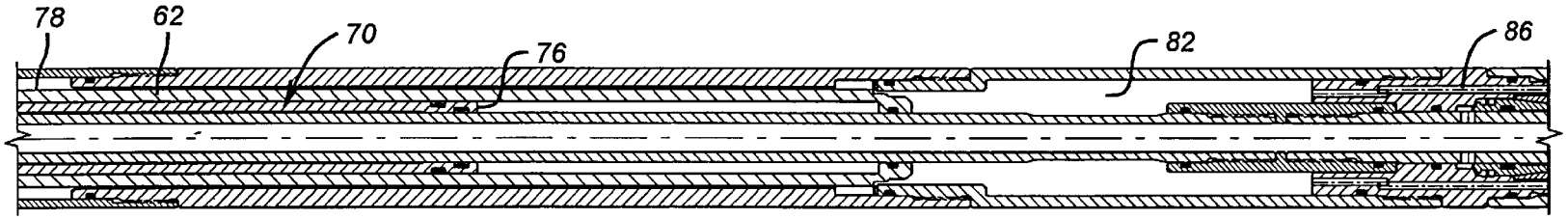
Figure 4D:
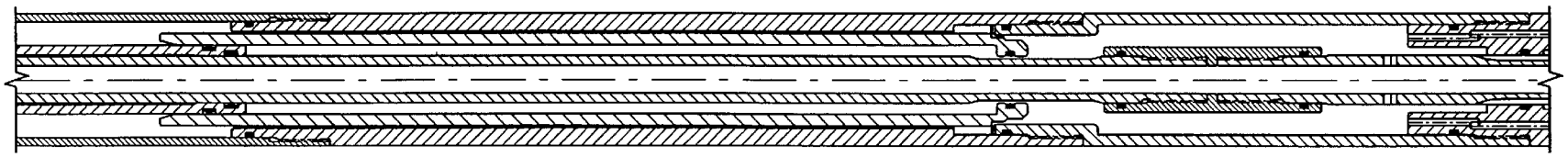
Figure 3E:
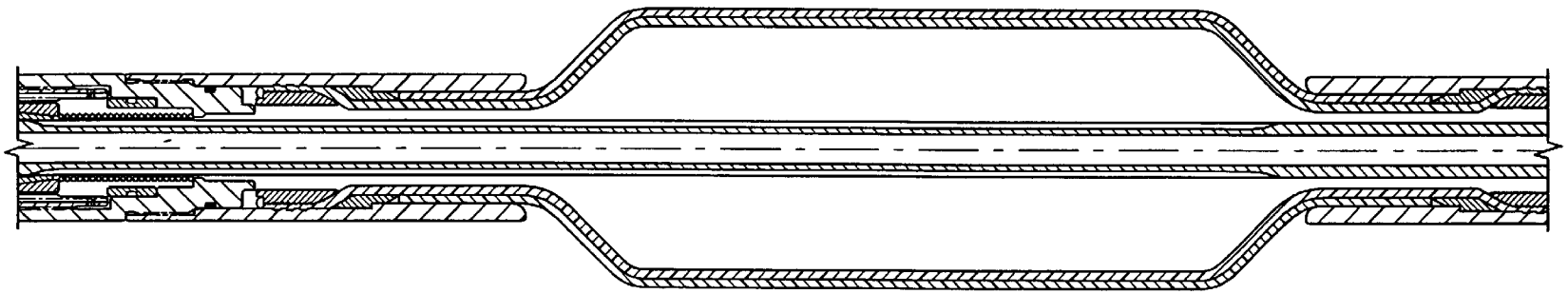
Figure 4E:
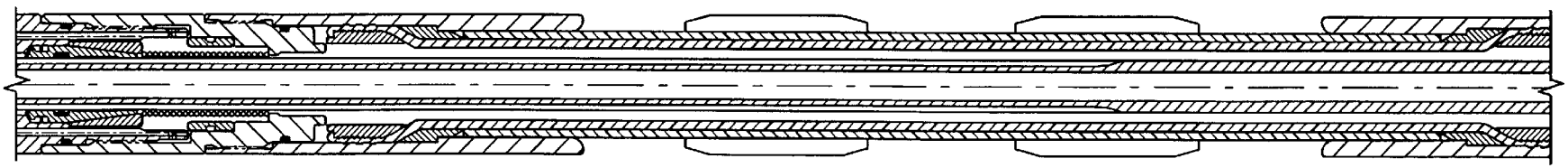
Figure 3F:
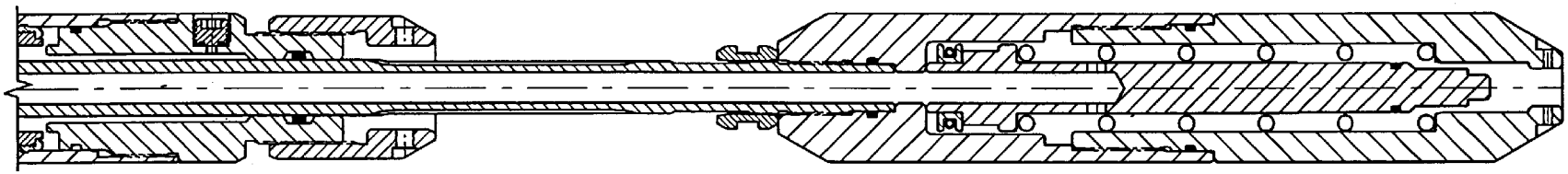
Figure 4F:
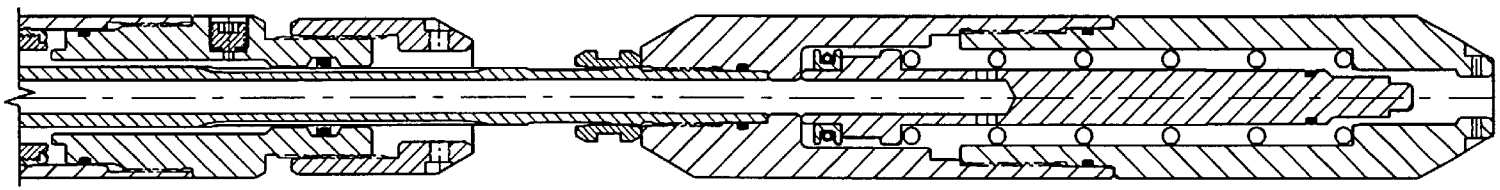

Eventually, sufficient pressure is applied inside of mandrel 54 to fully set the element on the inflatable packer with the pressure being built up high enough for an ultimate release from the packer. As an example, the element could inflate at approximately 400 psi within mandrel 54. A further pressure increase to around 600 psi would be used to break shear pin 146, with the release mechanism from the packer being actuated at about 3000 psi. Subsequent to that release, the pressure inside of the mandrel 54 decreases, which allows the spring 116, shown in FIG. 3b, to expand, pushing up spring piston 114. Upward movement of spring piston 114 takes seal 134 past surface 154, which is on the outside of the mandrel assembly 54. The upward movement of spring piston 114 in effect aligns port 138 to annular space 148. Thus, the pressure below the set inflatable packer is communicated through the mandrel 54 into port 138 to above the balancing piston 96 within annular space 148. At the same time, the upward movement of spring piston 114 shifts recess 130 sufficiently so as to bring seal 156 in juxtaposition with surface 158, effectively closing off port 128 by virtue of seals 132 and 156 which straddle port 128 on spring piston 114. Therefore, in the position shown in FIGS. 3*a–e*, the balancing piston 96 is now freely floating, with surfaces 102 and 104 in annular space 92 exposed to annulus pressure above the set inflatable through port 94, while opposing surfaces 140 and 142 are exposed to the formation pressure below the set inflatable by communication through the mandrel 54 and port 138. The ability of the balancing piston to float occurs because the upward movement of spring piston 114 pulls the dogs 106 off of shear ring 108, as shown in FIG. 3*b*. Accordingly, the new upper travel stop of the balancing piston 96 once the dogs 106 retract inwardly, as shown in FIG. 3*b*, is surface 160 on shear sub 34. During inflation, the element is inflated to well above the annulus presure so that the internal pressure exceeds the annulus pressure by more than the 30% area difference in the surfaces 90 and 84. Upon release of balancing piston 96, the inflate pressure in chamber 82 will decrease as piston 70 moves up slightly until the pressure in chamber 82 is about 30% higher than the pressure in chamber 92. Again, this balance is dictated by the area ratios of surfaces 90 and 84, neglecting surface 76 because pressure in chamber 68 is presumed negligible. In the ideal situation, upon the conclusion of inflation of the element in the packer, the downward forces on surfaces 140 and 142 should offset the upward forces on surface 84 so that very little net residual movement of balancing piston 96, spacer 88, and compensating piston 70 occurs. Depending on the area difference between surfaces 140 and 142 on one hand, and surface 84 on the other hand, there may be a slight shifting of compensating piston 70 immediately after inflation. However, despite this slight shifting, the compensating piston should be close to its mid-point in its available travel range between top end 78 of outer piston 62 and surface 152 on filler plug housing 26.

If purely thermal loads are applied with no pressure changes experienced, the compensator works to adjust by moving. Thus, if the temperature decreases, the compensating piston 70 moves downwardly toward top end 78 of outer piston 62. Conversely, if the temperature increases, the opposite movement of compensating piston 70 occurs toward shoulder 152. Upward movement toward shoulder 152 by compensating piston 70 will move balancing piston 96 with it. Opposite movement by compensating piston 70 toward top end 78 of outer piston 62 will simply allow the entire assembly, including balancing piston 96, to shift downwardly. Thus, without any pressure changes occurring downhole, the compensating device C of the present invention functions in response to increasing or decreasing temperatures by virtue of translation between its travel stops 78 and 152.

It may occur that there is injection pressure applied outside the compensating device C at the same time as a temperature change is occurring. If the injection pressure in the annular space outside the compensating device C increases, the pressure in annular space 92 will also increase. The formation pressure below the set packer will remain the same and the pressure will be communicated through port 138 into annular space 148 on the other side of balancing piston 96 from annular space 92. Thus, an unbalanced force will occur on balancing piston 96, tending to drive it uphole. At the same time, the increased injection pressure in the annular space, communicated through port 94 into annular space 92, will be applied to surface 90. Since surface 90 is larger than surface 84 by some predetermined ratio, a boost force is applied to passage 82 and, in turn, through passage 86 to under the element to keep it from collapsing under the increased injection pressure in the annular space outside the compensating device C. The net result should be a small movement of compensating piston 70, thus still leaving it between its travel stops 78 and 152 so that it is continually able to compensate for increases or decreases in temperature. It should be noted that upon increase in the pressure of the annular space outside the compensating device C, the residual pressure in annular space 68, which started at a predetermined value such as atmospheric, also acts to move the compensating piston 70 upwardly by exerting a very small force on surface 76.

Another possible scenario is that the annulus pressure drops outside the compensating device C. When this occurs, there is a net unbalanced downward force on the balancing piston 96 because the formation pressure remains constant, as does the pressure in annular space 148 which acts on surfaces 140 and 142. However, with the outer annular pressure dropping and communication occurring with surfaces 102 and 104 through port 94, the balancing piston 96 is urged downwardly. When contact is made with the inner spacer 88, the unbalanced downward force on balancing piston 96 is transferred to compensating piston 70. However, with the decrease in the annulus pressure, the pressure in annular space 92 is also decreasing. The pressure under the inflatable element, communicated to annular space 82, creates a net upward force on compensating piston 70. These two forces in opposite directions offset, perhaps with minor movement of the assembly due to the area differences of surfaces 102 and 104 compared to surface 84. This is because the pressure from below, communicated and applied to surfaces 140 and 142, results in a force which is offset by the inflate pressure under the inflatable element acting on the area of surface 84. Thus, when the compensating piston 70 in the circumstance of decreasing external annular pressure finds its equilibrium position, the ratio of the inflate pressure under the inflatable element and the formation pressure below is equal to the area of surfaces 140 and 142 divided by the area of surface 84. Ideally, the area of surfaces 140 and 142 should be between the areas of surface 84, on the one hand, and 90, on the other hand, and slightly larger than surface 84. For the purposes of simplification of the analysis, the area of surface 76 exposed to the annular space 68 is ignored. Thus, the force balance is as follows: The formation pressure below acts downwardly on surfaces 140 and 142. Surfaces 140 and 142 are equal in cross-sectional area to surfaces 102 and 104. Thus, there is an upward force on the surfaces 102 and 104 by virtue of the outer annulus pressure. The inflate pressure under the element acts on surface 84 upwardly, while the annulus pressure through port 94 acts downwardly on surface 90. Surface 90 is identical in area to surfaces 102 and 104 together or 140 and 142 together. The force balance simplifies to the formation pressure from below the inflatable element acting on an area such as surfaces 140 and 142 equals the inflation pressure under the inflatable element acting on the area of surface 84. From that the relationship is derived where the inflation pressure under the element equals the formation pressure below the element times the ratio of the areas of, for example, surface 90 divided by surface 84.

In the event of an increase in pressure from the formation, the annulus pressure above the inflated element and outside of the compensating device C remains the same. However, the increase in the formation pressure is communicated through port 138 onto the balancing piston 96. Since the pressure above the balancing piston 96 is increasing while the outer annulus pressure remains constant, there is a net downward force on balancing piston 96. This is communicated through spacer 88 to the compensating piston 70. At the same time, the rising formation pressure tends to increase the inflate pressure, which presents an offsetting force in annular space 82 acting on surface 84. Thus, because the formation pressure increases and such pressure is communicated to above the balancing piston 96, any tendency to increase the inflate pressure, due to a rise in formation pressure, creates an offsetting uphole force on compensating piston 70. The increased inflate pressure acts on surface 84, thus offsetting the downhole increased force applied by a pressure increase from the formation acting in annular space 148 on the balancing piston 96,. Since the areas of surfaces 140 and 142 on the one hand are only slightly larger than area 84, the assembly of the balancing piston 96 and compensating piston 70 finds a new equilibrium position while still leaving the compensating piston 70 between its travel stops 78 and 152. In that position, it can still further respond to thermal effects, regardless of the increase in formation pressure.

Those skilled in the art can appreciate that a drop in the annulus pressure outside the compensating device C and above the inflated element causes the same reaction as pressure increase in the formation below the inflated element. Similarly, the situation of additional pressure applied to the annulus outside the compensating device C is similar to a reduction in the formation pressure below the inflated element.

FIGS. 4*a–f* illustrate the removal of the mandrel 54 which causes the breaking of shear pin 160 attached to shear ring 108. In order to accomplish this, the collets 56 release shoulder 58 so that the mandrel assembly 54, including the latch sub 52, can be pulled out. This action deflates the element.

Accordingly, the compensating device C of the present invention is able to continue functioning to compensate for thermal variations upward or downward, despite the overlay of pressure changers whether those are increases or decreases and whether their origin is in the formation below the inflated element or in the annular space above the inflated element. The design is simple and compact and can prevent failure or release as an anchor which was possible with some of the prior art designs, such as the Tech Line design described in the background of the invention.

Although the preferred embodiment shows the assembly of pistons above the element, they both can be below the element and still function identically to compensate for pressure and temperature effects. The compensating piston 70 would have one end exposed to the formation pressure and the balancing piston 96 would have one end exposed to the annular space.

The foregoing disclosure and description of the invention are illustrative and explanatory thereof, and various changes in the size, shape and materials, as well as in the details of the illustrated construction, may be made without departing from the spirit of the invention.

What is claimed is:

1. A compensation system for an inflatable element for a packer, comprising:

a body;

a movable piston in said body to compensate for a thermally induced increase or decrease in pressure within the inflated element;

a balancing system on said body, said balancing system responsive to increased or decreased pressure external to the inflated element, compensating for its effects in a manner to allow said movable piston to continue to compensate for thermally induced pressure changes within the inflated element.

2. The system of claim 1, wherein:

said balancing system comprises a balancing piston in said body;

the inflatable element, when inflated downhole, creating an annular space above itself and around said body and isolating from said annular space another portion of the wellbore known as the formation pressure zone;

said balancing piston has a first end exposed to said annular space;

said movable piston has a first end exposed to said annular space.

3. A compensation system for an inflatable element for a packer, comprising:

a body;

a movable piston in said body to compensate for the thermally induced increase or decrease in pressure within the inflated element;

a balancing system on said body, said balancing system, responsive to applied pressure external to the inflated element, compensating for its effects in a manner to allow said movable piston to continue to compensate for thermally induced pressure changes within the inflated element;

said balancing system comprises a balancing piston in said body;

the inflatable element, when inflated downhole, creating an annular space above itself and around said body and isolating from said annular space another portion of the wellbore known as the formation pressure zone;

said balancing piston has a first end exposed to said annular space;

said movable piston has a first end exposed to said annular space;

said balancing piston has a second end selectively exposed to said formation pressure zone.

4. The system of claim 3, wherein:

said balancing piston selectively operably engageable to said movable piston under the influence of a pressure differential between said formation pressure zone and the pressure in said annular space.

5. The system of claim 4, wherein:

said movable piston having a second end exposed to the underside of the inflated element;

said second end of said movable piston having an end area nearly equal to an end area of said second end of said balancing piston;

whereupon operable engagement of said pistons due to said differential of said formation pressure zone and the pressure in said annular space, said balancing piston responds to said differential with slight movement leaving said movable piston in position to be able to still respond to thermally induced pressure changes within the inflated element.

6. The system of claim 5, wherein:

pressure under the inflated element acts on said second end of said movable piston in a direction opposite the pressure in said formation pressure zone acting on said second end of said balancing piston.

7. The system of claim 3, wherein:

said first end of said movable piston has an end area greater than a second end area on a second end of said movable piston which is exposed to pressure within the inflated element;

whereupon a positive difference between said annular space pressure and the pressure in said formation pressure zone, said end area difference provides force multiplication to within the inflated element to compensate.

8. The system of claim 7, wherein:

said balancing piston is selectively operably engageable to said movable piston under the influence of a pressure differential between said formation pressure zone and the pressure in said annular space.

9. The system of claim 8, wherein:

said second end of said movable piston having an end area nearly equal to an end area of said second end of said balancing piston;

whereupon operable engagement of said pistons due to said differential of said formation pressure zone and the pressure in said annular space, said balancing piston responds to said differential with slight movement leaving said movable piston in position to be able to still respond to thermally induced pressure changes within the inflated element.

10. The system of claim 9, wherein:

pressure under the inflated element acts on said second end of said movable piston in a direction opposite the pressure acting on said second end of said balancing piston.

11. The system of claim 10, wherein:

said balancing piston having a second end selectively exposed to pressure in said formation pressure zone;

said ends of said balancing piston having substantially equal end areas.

12. The system of claim 11, wherein:

said second end of said balancing piston exposed to pressure in said annular space during run-in, whereupon inflation of the element, said second end of said balancing piston is instead exposed to pressure in said formation pressure zone.

13. The system of claim 12, wherein:

the end area of either end of said balancing piston is less than the end area of said first end of said movable piston and greater than said end area of said second end of said movable piston.

14. The system of claim 7, wherein:

said second end of said movable piston comprises an additional end area exposed to an isolated chamber in said body which contains a predetermined low pressure in comparison with the ultimate pressure within the inflated element.

15. The system of claim 3, further comprising:

a spring piston movable from a first position, where pressure from said annular space is exposed to said second end of said balancing piston, to a second position, where pressure in said formation pressure zone is exposed to said second end of said balancing piston.

16. The system of claim 15, wherein:

said spring piston further comprising at least one locking dog to act as a travel stop to said balancing piston when said spring piston is in said first position;

whereupon inflation of the element, said spring piston moves to its said second position and said dog is retracted from acting as a travel stop for said balancing piston, allowing said balancing piston to float.

17. The system of claim 16, further comprising:

a spacer between said movable and balancing pistons, whereupon with said spring piston in said first position, said spacer stops movement of said movable piston as the element is inflated in a position between a pair of travel stops.

18. A method of isolating a portion of a wellbore, comprising:

running in an inflatable packer;

inflating an element on said packer to an inflate pressure;

compensating for downhole pressure changes above or below and outside the inflated element while retaining the ability to compensate for thermally induced changes to said inflate pressure at the same time.

19. The method of claim 18, further comprising:

providing a movable piston with a larger area on one side exposed to annulus pressure and a smaller area on an opposite side exposed to inflate pressure;

applying a force tending to offset effects on inflate pressure due to an increase in annulus pressure above the element or a decrease in formation pressure below the element.

20. A method of isolating a portion of a wellbore, comprising:

running in an inflatable packer;

inflating an element on said packer to inflate pressure;

compensating for downhole pressure changes above or below the inflated element while retaining the ability to compensate for thermally induced changes to said inflate pressure at the same time;

providing a movable piston with a larger area on one side exposed to annulus pressure and a smaller area on an opposite side exposed to inflate pressure;

applying a force tending to offset effects on inflate pressure due to an increase in annulus pressure above the element or a decrease in formation pressure below the element;

providing a balancing piston having a first end exposed to said annular space and a second end exposed to formation pressure below the element;

sizing the area of said second end of said balancing piston to be larger than said smaller area on said movable piston and smaller than said larger area on said movable piston;

using said balancing piston to act on said movable piston to compensate for effects on the inflate pressure caused by a decrease in annulus pressure or an increase in formation pressure.

21. The method of claim 20, further comprising:

putting said balancing piston in pressure balance during run-in by exposing its opposed ends of substantially equal area to annulus pressure during run-in;

shifting one end of said balanced piston to exposure to formation pressure as a result of inflation of the element.

22. The method of claim 20, further comprising:

selectively defining, in one direction, the maximum travel position of said balancing piston during inflation of said element;

spacing said movable piston between travel stops to facilitate its subsequent response to thermal effects on said inflate pressure as a result of operable contact with said balancing piston disposed at its said maximum travel position;

releasing said maximum travel position on said balancing piston after obtaining the desired positioning of said movable piston responsive to an applied inflation pressure.

23. A compensation system for an inflatable element for a packer, comprising:

a body;

a movable piston in said body to compensate for a thermally induced increase or decrease in pressure within the inflated element;

a balancing system on said body, said balancing system responsive to applied pressure external to the inflated element, compensating for its effects in a manner to allow said movable piston to continue to compensate for thermally induced pressure changes within the inflated element;

said balancing system comprises a balancing piston in said body;

the inflatable element, when inflated downhole, creating an annular space above itself and around said body and isolating from said annular space another portion of the wellbore known as the formation pressure zone;

said balancing piston has a first end exposed to said annular space;

said movable piston has a first end exposed to said formation pressure zone.

24. A compensation system for an inflatable element for a packer, comprising:

a body; a movable piston in said body to compensate for a thermally induced increase or decrease in pressure within the inflated element;

a balancing system on said body, said balancing system, responsive to applied pressure external to the inflated element, compensating for its effects in a manner to allow said movable piston to continue to compensate for thermally induced pressure changes within the inflated element;

said balancing system comprises a balancing piston in said body;

the inflatable element, when inflated downhole, creating an annular space above itself and around said body and isolating from said annular space another portion of the wellbore known as the formation pressure zone;

said balancing piston has a first end exposed to said annular space;

said movable piston has a first end exposed to said formation pressure zone;

said balancing piston has a second end selectively exposed to said annular space.

25. The method of claim 24, further comprising:

said balancing piston selectively operably engageable to said movable piston under the influence of a pressure differential between said formation pressure zone and the pressure in said annular space.

26. The method of claim 24, further comprising:

a spring piston movable from a first position, where pressure from said annular space is exposed to said second end of said balancing piston, to a second position, where pressure in said formation pressure zone is exposed to said second end of said balancing piston.

27. A method of isolating a portion of a wellbore, comprising:

running in an inflatable packer;

inflating an element on said packer to an inflate pressure;

compensating for downhole pressure changes above or below and outside the inflated element while retaining the ability to compensate for thermally induced changes to said inflate pressure at the same time;

providing a movable piston with a larger area on one side exposed to formation pressure and a smaller area on an opposite side exposed to inflate pressure;

applying a force tending to offset effects on inflate pressure due to an increase in formation pressure below the element or a decrease in annulus pressure above the element.

28. A method of isolating a portion of a wellbore, comprising:

running in an inflatable packer;

inflating an element on said packer to an inflate pressure;

compensating for downhole pressure changes above or below the inflated element while retaining the ability to compensate for thermally induced changes to said inflate pressure at the same time;

providing a movable piston with a larger area on one side exposed to formation pressure and a smaller area on an opposite side exposed to inflate pressure;

applying a force tending to offset effects on inflate pressure due to an increase in formation pressure below the element or a decrease in annulus pressure above the element;

providing a balancing piston having a first end exposed to said annular space and a second end exposed to formation pressure below the element;

sizing the area of said second end of said balancing piston to be larger than said smaller area on said movable piston and smaller than said larger area on said movable piston;

using said balancing piston to act on said movable piston to compensate for effects on the inflate pressure caused by a decrease in annulus pressure or an increase in formation pressure.

29. The method of claim 28, further comprising:

putting said balancing piston in pressure balance during run-in by exposing its opposed ends of substantially equal area to formation pressure during run-in;

shifting one end of said balanced piston to exposure to annulus pressure as a result of inflation of the element.

30. The method of claim 29, further comprising:

selectively defining, in one direction, the maximum travel position of said balancing piston during inflation of said element;

spacing said movable piston between travel stops to facilitate its subsequent response to thermal effects on said inflate pressure as a result of operable contact with said balancing piston disposed at its said maximum travel position;

releasing said maximum travel position on said balancing piston after obtaining the desired positioning of said movable piston responsive to an applied inflation pressure.

* * * * *